US008590090B2

(12) United States Patent
Porat et al.

(10) Patent No.: US 8,590,090 B2
(45) Date of Patent: Nov. 26, 2013

(54) ADJUSTABLE INTAKE PORT FOR SUBMERSIBLE POOL AND TANK CLEANER

(71) Applicant: Aqua Products, Inc., Cedar Grove, NJ (US)

(72) Inventors: Joseph Porat, Del Ray Beach, FL (US); Giora Erlich, North Caldwell, NJ (US)

(73) Assignee: Aqua Products, Inc., Cedar Grove, NJ (US)

( * ) Notice: Subject to any disclaimer, the term of this patent is extended or adjusted under 35 U.S.C. 154(b) by 0 days.

(21) Appl. No.: 13/632,428

(22) Filed: Oct. 1, 2012

(65) Prior Publication Data

US 2013/0030659 A1 Jan. 31, 2013

Related U.S. Application Data

(63) Continuation-in-part of application No. 12/283,490, filed on Sep. 11, 2008, now Pat. No. 8,505,142.

(60) Provisional application No. 61/547,462, filed on Oct. 14, 2011.

(51) Int. Cl.
*E04H 4/16* (2006.01)

(52) U.S. Cl.
USPC ..... 15/1.7

(58) Field of Classification Search
USPC ..... 15/1.7
See application file for complete search history.

(56) References Cited

U.S. PATENT DOCUMENTS

| | | | | |
|---|---|---|---|---|
| 5,105,496 | A * | 4/1992 | Gray et al. | 15/1.7 |
| 5,634,229 | A * | 6/1997 | Stoltz | 15/1.7 |
| 6,758,226 | B2 * | 7/2004 | Porat | 134/56 R |
| 7,293,314 | B2 * | 11/2007 | Henkin et al. | 15/1.7 |
| 2010/0058546 | A1 * | 3/2010 | Erlich | 15/1.7 |

* cited by examiner

*Primary Examiner* — Randall Chin
(74) *Attorney, Agent, or Firm* — Abelman, Frayne & Schwab

(57) ABSTRACT

A base plate for a self-propelled robotic cleaning apparatus for cleaning a submerged surface of a pool or tank. The base plate includes a bottom surface and a water inlet formed therethrough, and an inlet extension member configured to mount in the water inlet. The inlet extension member is slidably retractable and extendable in a direction that is normal relative to the bottom surface of the base plate. A height adjustment mechanism is coupled to the inlet extension member and configured to move the inlet extension member upwardly and downwardly in the normal direction relative to the bottom surface of the base plate. The height adjustment mechanism can be adjusted manually. Alternatively, at least one sensor is operably coupled to a controller to automatically control the height adjustment mechanism.

19 Claims, 12 Drawing Sheets

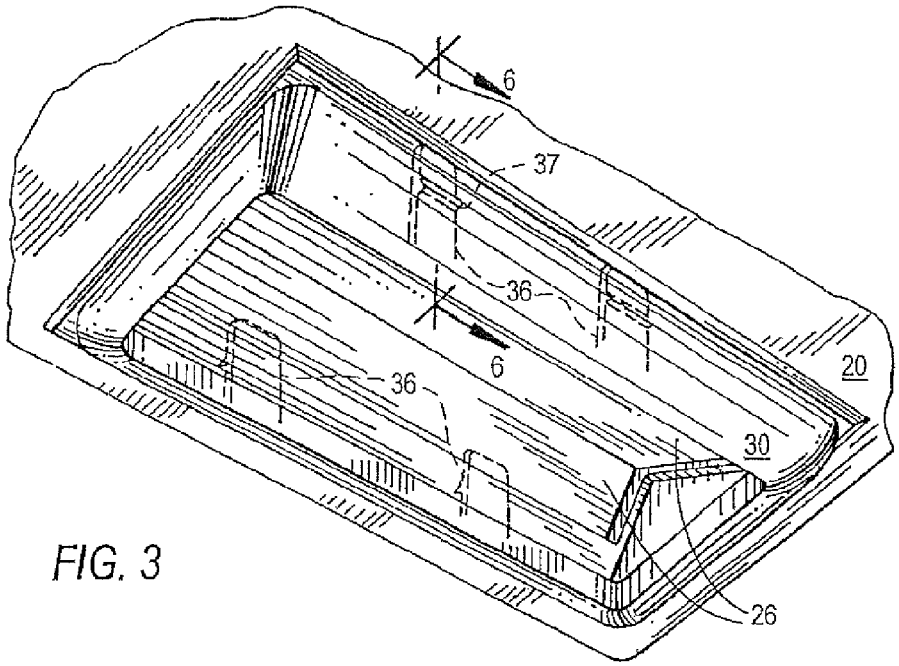
FIG. 3
FIG. 4
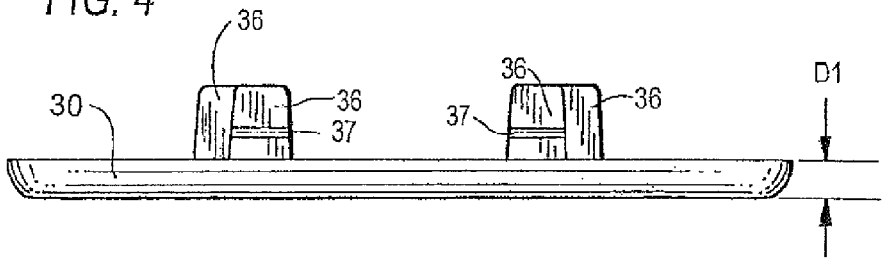

FIG. 5
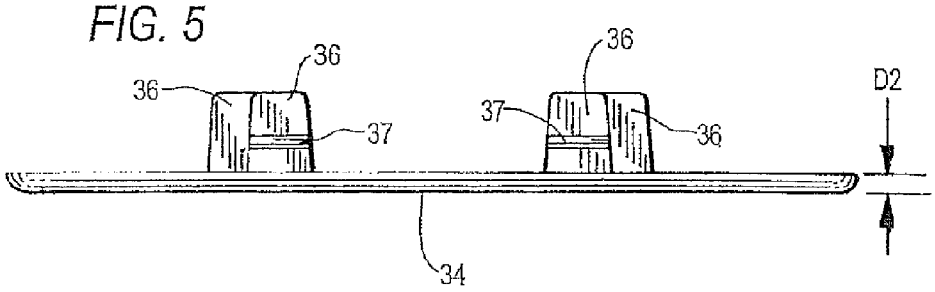
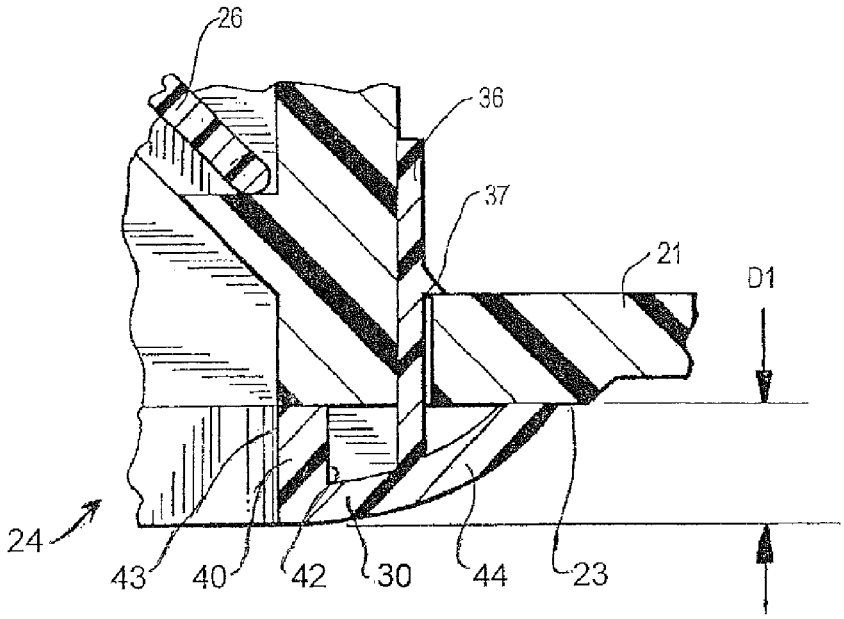
FIG. 6

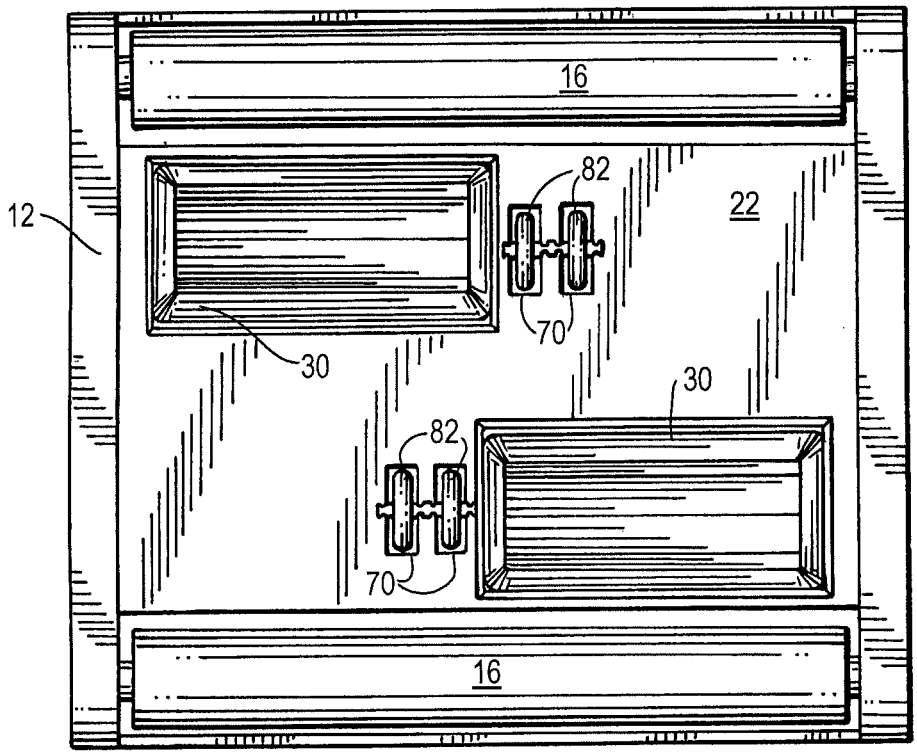
FIG. 10
FIG. 11
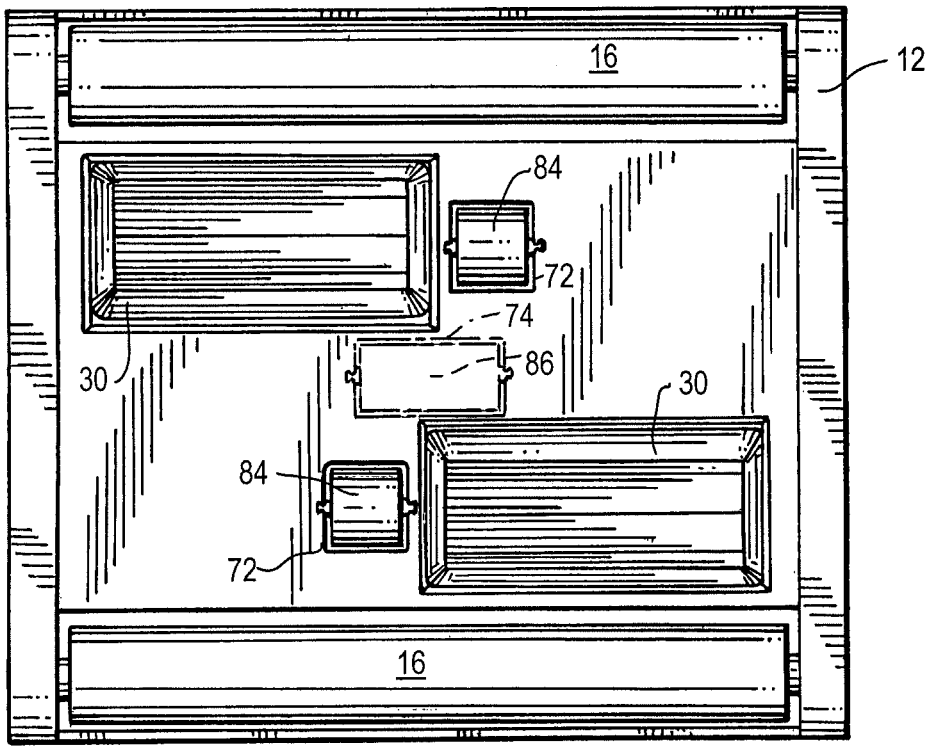

FIG. 15
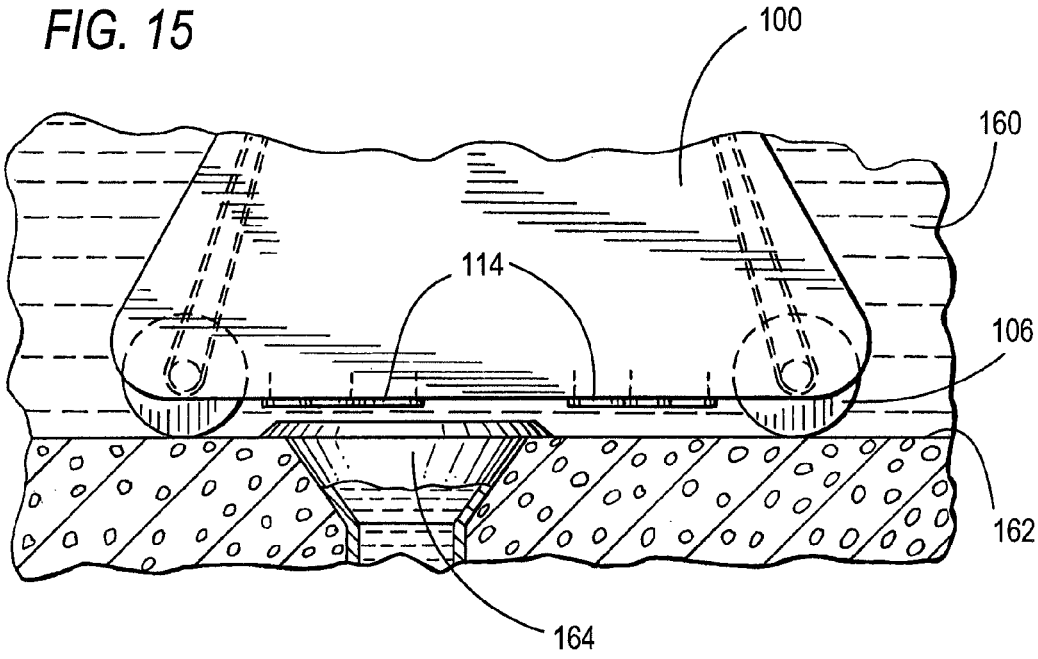
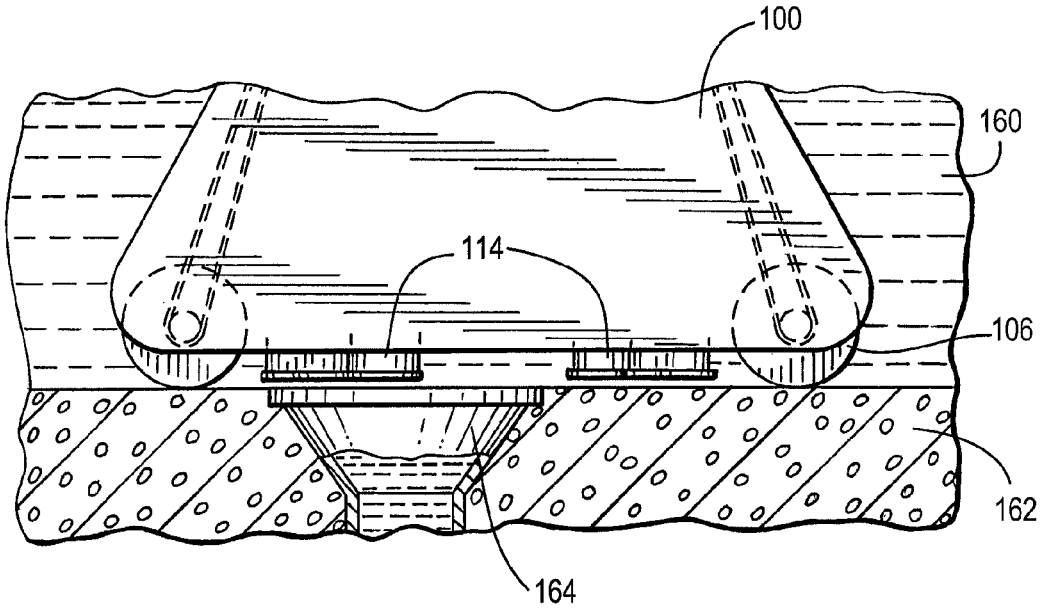
FIG. 16

FIG. 17
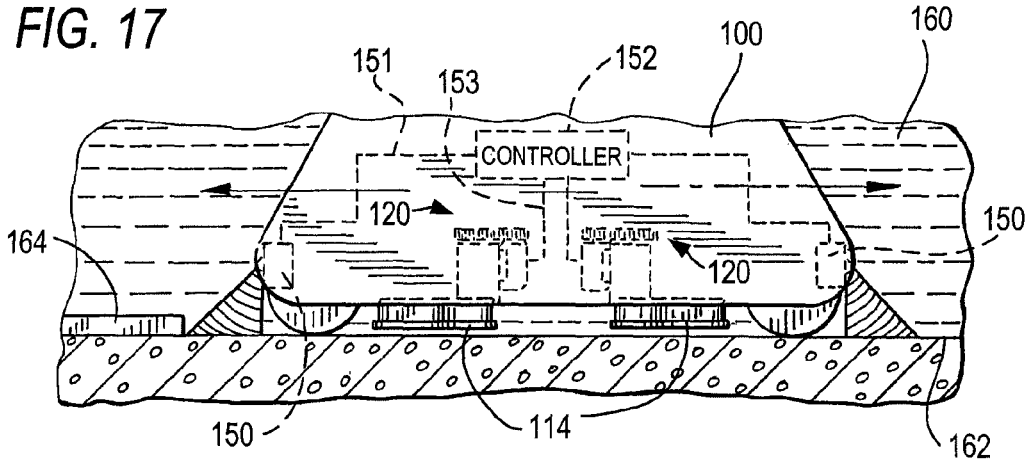
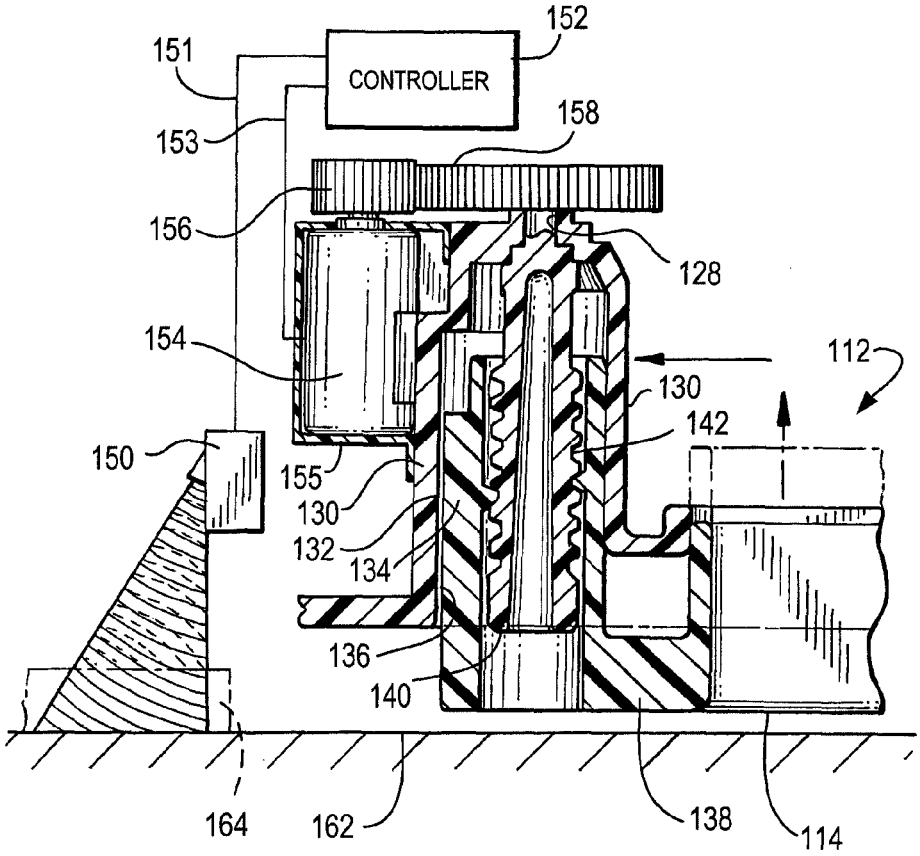
FIG. 18

ADJUSTABLE INTAKE PORT FOR SUBMERSIBLE POOL AND TANK CLEANER

CROSS REFERENCE TO RELATED APPLICATIONS

This application is a continuation-in-part application of U.S. application Ser. No. 12/283,490, filed Sep. 11, 2008 now U.S. Pat. No 8,505,142, and this application also claims the benefit of U.S. Provisional Application Ser. No. 61/547,462, filed Oct. 14, 2011, and the content of both applications are incorporated by reference herein in their entireties.

FIELD OF INVENTION

This invention relates to a robotic self-propelled submersible pool and tank cleaner, and more specifically to one or more water intake ports positioned along a base of the cleaner.

BACKGROUND OF THE INVENTION

Automated or robotic swimming pool cleaners traditionally contact and move about on the pool bottom and wall surfaces being cleaned on four axle-mounted wheels, resilient rollers that are transversely mounted at either end of the unit, or on endless tracks that are powered by a separate drive motor through a gear train to propel the robot over the surfaces of the pool that are to be cleaned. The water pump can drive a water turbine connected via a gear train to the wheels or endless track. Robotic swimming pool cleaners have a pump motor that powers a water pump, which in turn causes the drawing of water through the moving unit, and the drawn, i.e., moving water dislodges and/or "vacuums" debris up into a filter. The water pump can be internal or external to the robotic cleaner. For cleaning apparatus having an internal pump, the water exiting the cleaner in the form of a pressurized stream or water jet can also be used to move the cleaning apparatus by reactive force.

Automated power-driven pool and tank cleaners are provided with pre-programmed solid state control devices to cause random and/or regular patterns of movement of the apparatus. The purpose of the programmed movement is to maximize the probability that the apparatus will cover the entire bottom and, optionally, the side wall surfaces during the cleaning operation in as little time as possible. An efficient cleaning pattern can also be selected based on the shape and size of the pool.

Often the bottom of a pool or tank has projections or an uneven surface. These projections and/or uneven surface contours can become obstacles which can stop a robotic cleaner or delay the apparatus with much of the directional cycle spent with the apparatus immobilized or diverted from its intended cleaning path. This is an undesirable result because it lengthens the cleaning time and wastes externally provided electricity or the power of an on-board battery. Furthermore, the obstacle or contour can change the route of patterned travel of the cleaning apparatus, thereby reducing cleaning efficiency.

Prior art pool cleaners have addressed the problems of obstacles and extreme surface contours. One prior art method is to reverse and/or change direction of the apparatus when its intended forward movement is prevented. For example, U.S. Pat. No. 6,758,226 to Porat describes an automatic power-driven pool cleaning apparatus in which a motion translation member contacts the surface being cleaned and an associated signal transmitter and a motion sensor is connected to the pool cleaner's electronic control device. When the cleaner is moving, the motion results in a predetermined signal pattern and when the cleaner stops, the signal pattern is interrupted. After a predetermined period of time, the control device causes the cleaner's drive means to move the cleaner in a different direction. The obvious drawback is that the regular pattern of travel is changed thereby potentially reducing the efficiency of the cleaning apparatus.

Another solution to the problem of obstacles is to raise the base plate by employing larger diameter wheels or supporting propulsion rollers, or by providing adjustable mounting means so that the user can change the distance between the underside of the base plate and the pool surface depending upon the specific conditions present in the pool. However, pool cleaners remove dirt and debris from surfaces traversed by applying a suction force proximate to the surface to be cleaned to draw debris that rests on, or that is suspended close to the surface beneath the apparatus through openings in the base plate and into a filter. The interior edge of the inlet opening is preferably near or on the longitudinal center axis running along the base plate. Since the suction force diminishes rapidly with an increase in distance between the surface being cleaned and the base plate inlet openings, merely raising the base plate is not a practical solution to the problem of obstacles that project from the bottom or sidewall of the pool.

Commonly assigned U.S. application publication no. 2010/0058546 to Erlich describes yet another solution to the problem of navigation over obstacles along the pool surface. In particular, optimizing the position of the inlet opening and maximizing the amount of suction force to remove debris from the surface being cleaned is illustratively provided with interchangeable inlet extension members that come in a kit and which can be used to lower the suction point relative to the surface being cleaned. The interchangeable extension members can also be used to decrease the effective area of the suction openings to thereby increase the velocity of the water drawn into the inlet opening. When used in combination with recessed wheels, the inlet extension members provide improved cleaning efficiency, even in pools having surface obstacles that could otherwise interfere with the patterned movement of the cleaner. The interchangeable extension members are provided in a kit of varying sizes that must be installed and removed manually by the user.

Although the prior art solutions to navigate over obstacles along the pool surface have been adequate, nowhere in the prior art is there any inlet extension members that can be adjusted up and down to a desired height or depth, and without manual replacement of one extension member with another.

It would therefore be desirable to provide a method and apparatus for cleaning the bottom and side walls of pools and tanks that have projecting surface obstacles or extreme contours without stopping or significantly interrupting or altering the cleaning pattern of a self-propelled robotic cleaner.

It would also be desirable to provide a means for easily and economically increasing the suction force for existing pool cleaning apparatus in order to provide an improved degree of cleaning for different types of pool surfaces.

It is further desirable to provide a means for adjusting the height of an inlet extension member with respect to the surface over which the cleaner is cleaning the pool or tank.

It is also desirable to provide a cleaner with an adjustable inlet extension member that does not require interchangeable components that must be manually interchanged for different cleaning environments.

It is also desirable to provide a cleaner with an adjustable inlet extension member that does not include interchangeable components in a kit that are subject to being lost or damaged during storage.

SUMMARY OF THE INVENTION

The above objects and further advantages are achieved by providing a base plate for a self-propelled robotic cleaning apparatus for cleaning a submerged surface of a pool or tank. The base plate includes a bottom surface and a water inlet formed therethrough. An inlet extension member is configured to mount in the water inlet, and more specifically, the inlet extension member is slidably retractable and extendable in a direction that is normal relative to the bottom surface of the base plate. A height adjustment mechanism is coupled to the inlet extension member and configured to move the inlet extension member upwardly and downwardly in the normal direction relative to the bottom surface of the base plate.

In one aspect, the inlet extension member includes at least one sidewall extending substantially normal to the bottom surface of the base plate. The inlet extension member can include a flange extending outwardly substantially normal from a lower portion of the at least one sidewall of the inlet extension member, such that the outwardly extending flange overlaps a portion of the bottom surface of the base plate.

In another aspect, the height adjustment mechanism is coupled to the inlet extension member via a connecting flange. Additionally, the height adjustment mechanism can include a threaded bolt for adjusting the distance the inlet extension member extends relative to the bottom surface of the base plate. The threaded bolt is rotatable in either a clockwise or counter-clockwise direction to retract and extend the inlet extension member to any one of a fully retracted position, a fully extended position and to any position therebetween.

In yet another aspect, the height adjustment mechanism further comprises an external sleeve fixedly mounted to an upper surface of the base plate and having a cylindrical interior channel. A cylindrical internal sleeve is slidably positioned coaxially within the cylindrical interior channel of the external sleeve. The internal sleeve has an internal channel that is threaded and configured to interface with the threaded bolt.

In one aspect, the internal sleeve is coupled to a sidewall of the inlet extension member by the connecting flange. Further, one of clockwise rotation or counter-clockwise rotation of the threaded bolt causes the internal sleeve and the inlet extension member to move contemporaneously in a normal direction relative to the bottom surface of the base plate.

In still another aspect, the base plate includes at least one sidewall extending upward into the interior of the housing in a direction substantially normal to the bottom surface of the base plate and adjacent to a respective at least one sidewall of the inlet extension member.

In one aspect, the height adjustment mechanism is manually operated. Alternatively, the height adjustment mechanism is operated automatically.

In one embodiment, the height adjustment mechanism is coupled to an electric motor. The electric motor is operable to control the distance the inlet extension member extends relative to the bottom surface of the base plate.

In one aspect, a sensor is mounted to the cleaning apparatus and coupled to the electric motor. The sensor is operable to send control signals to the electric motor to retract the inlet extension member in response to sensing an obstacle on the submerged surface while the cleaning apparatus moves along the submerged surface of a pool or tank. In yet another aspect, the sensor is operable to send control signals to the electric motor to extend the inlet extension member in response to sensing that the obstacle has been cleared while the cleaning apparatus moves along the submerged surface of a pool or tank.

In another embodiment, the cleaning apparatus further comprises an electronic controller having at least one input for receiving output signals from the sensor and an output for sending control signals to the height adjustment mechanism to control the distance the inlet extension member extends relative to the bottom surface of the base plate. In one aspect, the distance the inlet extension member is extendible relative to the bottom surface of the base plate is in the range of being fully retracted and fully extended.

In yet another embodiment, the electric motor is a reversible motor having a drive gear, and the height adjustment mechanism comprises a threaded bolt having a driven gear for adjusting the distance the inlet extension member extends relative to the bottom surface of the base plate. An external sleeve is fixedly mounted to an upper surface of the base plate and has a cylindrical interior channel. A cylindrical internal sleeve is slidably positioned coaxially within the cylindrical interior channel of the external sleeve. The internal sleeve has an internal channel that is threaded and configured to interface with the threaded bolt, and the internal sleeve is coupled to a sidewall of the inlet extension member by the connecting flange. The drive gear interfaces with the driven gear to rotate the threaded bolt in either a clockwise or counter-clockwise direction to retract and extend the inlet extension member to any one of a fully retracted position, a fully extended position and to any position therebetween.

In still another embodiment, the electric motor is an actuator and the height adjustment mechanism comprises an actuator rod extending longitudinally from the actuator for adjusting the distance the inlet extension member extends relative to the bottom surface of the base plate. An external sleeve is fixedly mounted to an upper surface of the base plate and has a cylindrical interior channel. A cylindrical internal sleeve is slidably positioned coaxially within the cylindrical interior channel of the external sleeve. The internal sleeve has an internal channel for receiving the actuator rod, and the internal sleeve is coupled to a sidewall of the inlet extension member by the flange. The actuator rod is fastened to a portion of the internal sleeve to move the internal sleeve in either an upwardly or downwardly direction to retract and extend the inlet extension member to any one of a fully retracted position, a fully extended position and to any position therebetween.

In another embodiment, a method is provided for extending and retracting an inlet extension member associated with a water inlet formed in a base plate of a self-propelled robotic cleaning apparatus for cleaning a submerged surface of a pool or tank, the cleaning apparatus including a housing having a front portion, an opposing rear portion and adjoining side portions defining an interior and exterior periphery of the cleaning apparatus; rotationally-mounted supports coupled proximate the front and rear portions of the housing, and a base plate having a bottom surface and a water inlet formed therethrough; the inlet extension member configured to slidably mount in the water inlet to slidably retract and extend in a direction that is normal relative to the bottom surface of the base plate; and a height adjustment mechanism coupled to the inlet extension member and configured to move the inlet extension member upwardly and downwardly in the normal direction relative to the bottom surface of the base plate; and a sensor mounted to the housing and operably coupled to the height adjustment mechanism, said sensor operable to send control signals to an electronic controller having at least one input for receiving output signals from the sensor and an output for transmitting control signals to the height adjustment mechanism to control the distance the inlet extension member extends relative to the bottom surface of the base plate, the method comprising: moving the cleaning apparatus along a cleaning path on the submerged surface of the pool; sensing an obstacle protruding upward ahead of the cleaning apparatus from the submerged surface of the pool along the cleaning path; and in response to sensing the obstacle, automatically retracting the inlet extension member into the base plate a predetermined distance prior to the cleaning apparatus contacting the obstacle along the cleaning path. In one aspect, the method further comprises automatically extending the inlet extension member from the base plate a predetermined distance after the cleaning apparatus has cleared the obstacle along the cleaning path.

BRIEF DESCRIPTION OF THE DRAWINGS

The invention will be described in detail below and with reference to the attached drawings in which:

FIG. 3 is an enlarged bottom perspective view of a portion of the baseplate of FIG. 2 showing the installation of the inlet extension member of FIG. 4;

FIG. 4 is a side view of one embodiment of an inlet extension member of the invention.

FIG. 5 is a side view of another embodiment of an inlet extension member of the present invention;

FIG. 6 is an enlarged side view, partially in cross-section, showing a mounting detail of a portion of the inlet extension member of FIG. 3 taken along line 6-6;

FIG. 10 is a bottom view similar to FIG. 8 showing another embodiment of the recessed wheels of the invention; and FIG. 11 is a bottom view similar to FIG. 8 showing yet another embodiment of the recessed wheels of the invention.

FIG. 15 is a side elevation view of a portion of the pool cleaner of FIG. 1 illustratively moving over an obstacle along the surface of the pool and with the inlet extension members in their retracted positions with respect to the base plate;

FIG. 16 is a side elevation view of a portion of the pool cleaner of FIG. 1 illustratively moving over an unimpeded surface of the pool and with the inlet extension members in their extended positions with respect to the base plate;

FIG. 17 is a side elevation view of a portion of another embodiment of the pool cleaner of FIG. 1 having a navigation sensor and illustrating a second embodiment of the height adjustment mechanism while illustratively moving over an unimpeded surface of the pool and with the inlet extension members in their extended positions with respect to the base plate;

FIG. 18 is an enlarged side elevation view of a portion of the pool cleaner of FIG. 6 illustrating the second embodiment of the height adjustment mechanism of the present invention.

DETAILED DESCRIPTION OF THE INVENTION

Figure 1:
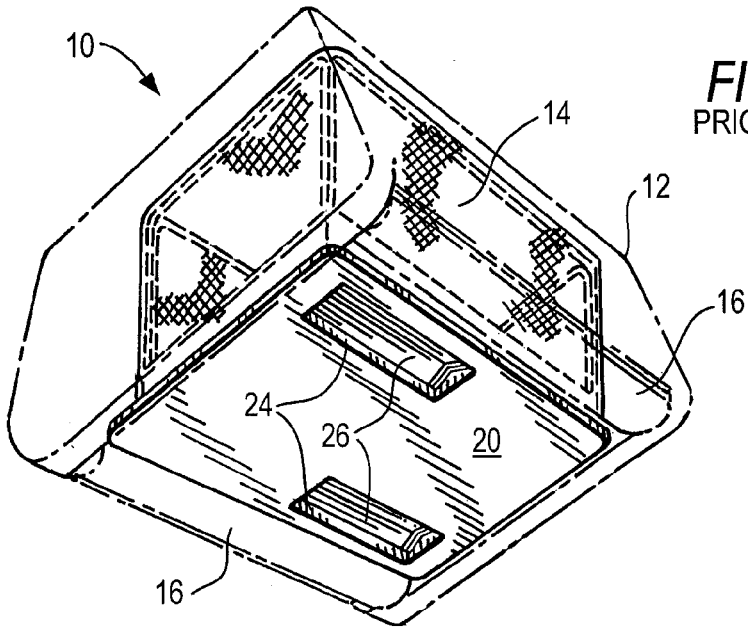
FIG. 1 PRIOR ART
FIG. 1 is a bottom perspective view of a baseplate of the prior art in position on a pool cleaner, the later being shown in phantom.

Referring to FIG. 1, a representative self-propelled robotic pool cleaner 10 of the prior art has an exterior housing 12, an internal filter assembly 14, transverse power driven rollers 16 and a baseplate 20 is schematically depicted. Baseplate 20 is attached to the bottom of the housing 12 and, as illustrated, has two inlet openings 24 that are closed by a pair of biased doors 26 that close when the water flow to the filter is stopped.

Figure 2:
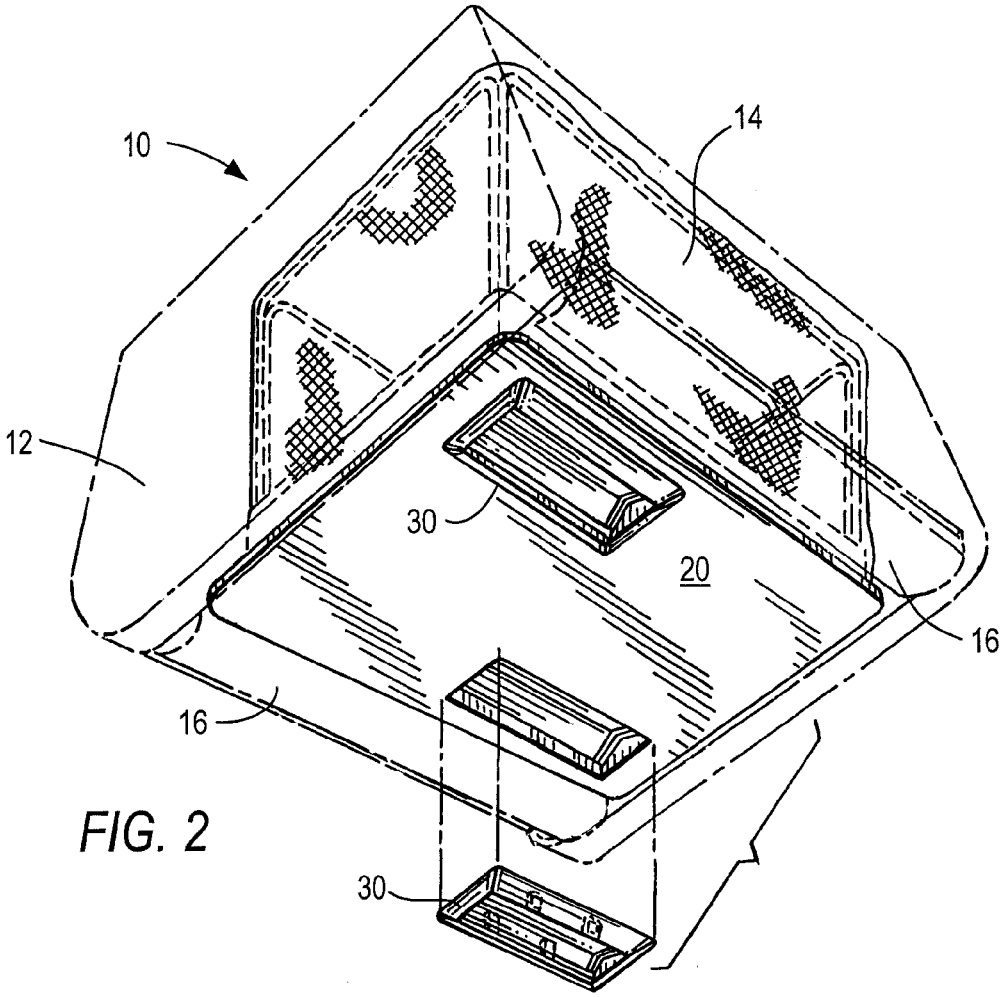
FIG. 2 is a view of a baseplate similar to FIG. 1, showing inlet extension members of the present invention attached and in position for mounting on the baseplate.

Referring now to FIG. 2, the baseplate 20 has been fitted with an inlet extension member, referred to generally as 30, that is assembled in a snap-fitting relation; a second inlet extension member is shown in position for attachment to the baseplate. As most clearly shown in FIGS. 3, 4 and 5, the inlet extension member 30 is formed with a plurality of upwardly projecting members, e.g., clips 36 that are semi-flexible and provided with projecting elements, e.g., ridges 37 that engage the baseplate.

FIGS. 4 and 5 are side views of two inlet extension members 30 of different depths D1 and D2, respectfully, where "D" generally represents the depth that the inlet extension member 30 extends below the exterior surface of the baseplate 20.

The lesser depth (e.g., D2 as shown in FIG. 5) of inlet extension member 30 raises the suction point of the cleaning apparatus closer to the baseplate 20. The use of an inlet extension member having lesser depth can be beneficial in situations where, for example, obstacles project higher from the surface to be cleaned and would otherwise immobilize or significantly divert the pool cleaner from its intended programmed movement pattern by contacting the rim of the inlet extension member.

Referring now to FIG. 6, there is shown a cross-sectional view of the inlet extension member 30 viewed along the section line 6-6 of FIG. 3. The extension member 30 is removable from the baseplate 20 and includes at least one wall 40 having an outer surface 42 and inner surface 43 where the outer surface 42 is configured to correspond in size and shape to the baseplate water inlet opening 24 formed through the baseplate 20 of the pool cleaner 10. The inner surface 43 of the at least one wall 40 defines an extended inlet for drawing the pool water through the baseplate inlet extension member 30. The at least one wall 40 extends substantially perpendicular from the substantially planar exterior surface 23 of the baseplate 20 towards the distally adjacent pool surface over which the pool cleaner 10 moves during normal operation and terminates in a rim portion 44. As shown in FIGS. 3 and 6, the rim portion 44 also extends radially outwards to define a flange which circumscribes the baseplate water inlet opening 24. Preferably,the outwardly extending e of the rim portion 44 is curved from the inner surface 43 or outer surface 42 of the wall 40 towards the planar exterior surface 23 of the baseplate 20. In FIG. 5, the extension member 30 illustratively has a predetermined depth of "D2", whereas referring to FIGS. 4 and 6 the extension member 30 has a depth of "Dl". Installing an extension member 30 having a predetermined depth, e.g., Dl or D2, is based on the surface conditions of the pool and the amount of suction desired, as described below in further detail. The projecting elements 37 (e.g., ridges) engage the interior surface 21 of baseplate 20. In a preferred embodiment, the projecting member 36 (e.g., clip) is sufficiently flexible to permit its disengagement and removal.

Figure 7:
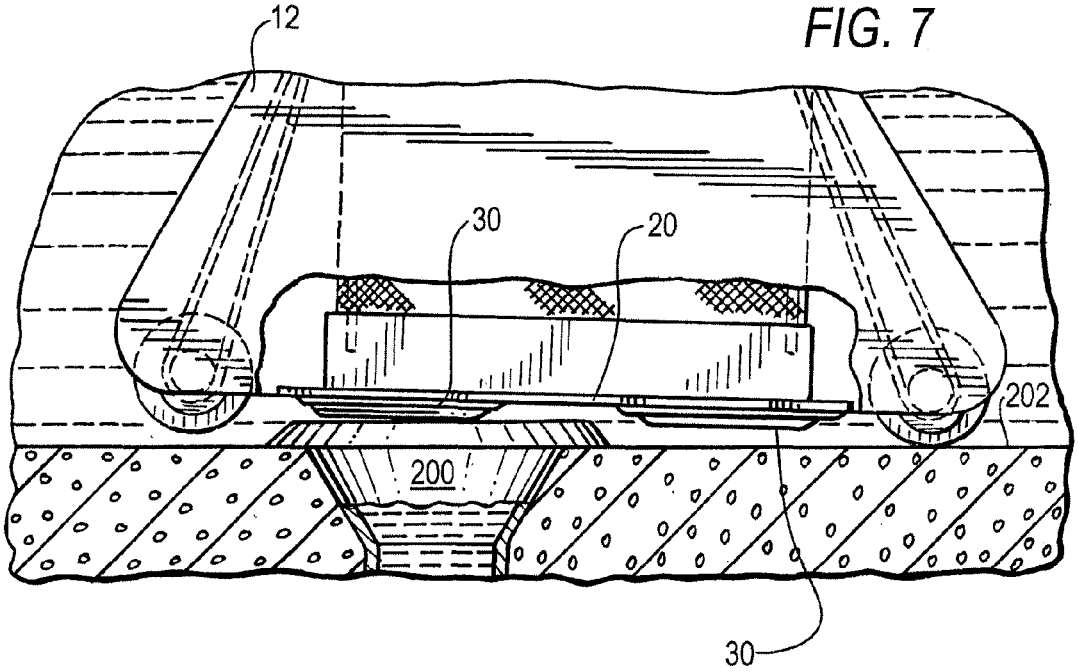
FIG. 7 is a side elevation view of a portion of a pool cleaner immobilized by an inlet extension member contacting an obstacle projecting from the pool surface being cleaned.

As shown in the illustration of FIG. 7, the lower rim surface of inlet extension member 30 can project sufficiently below baseplate 20 that it comes into frictional contact with obstacles projecting above the surface 202 of the pool that is being cleaned. As shown, a water inlet cover 200 projects above pool surface 202 and the pool cleaner 10 is immobilized as a result of one or both of rollers 16 making insufficient frictional contact to maintain the movement of the unit.

Figure 8:
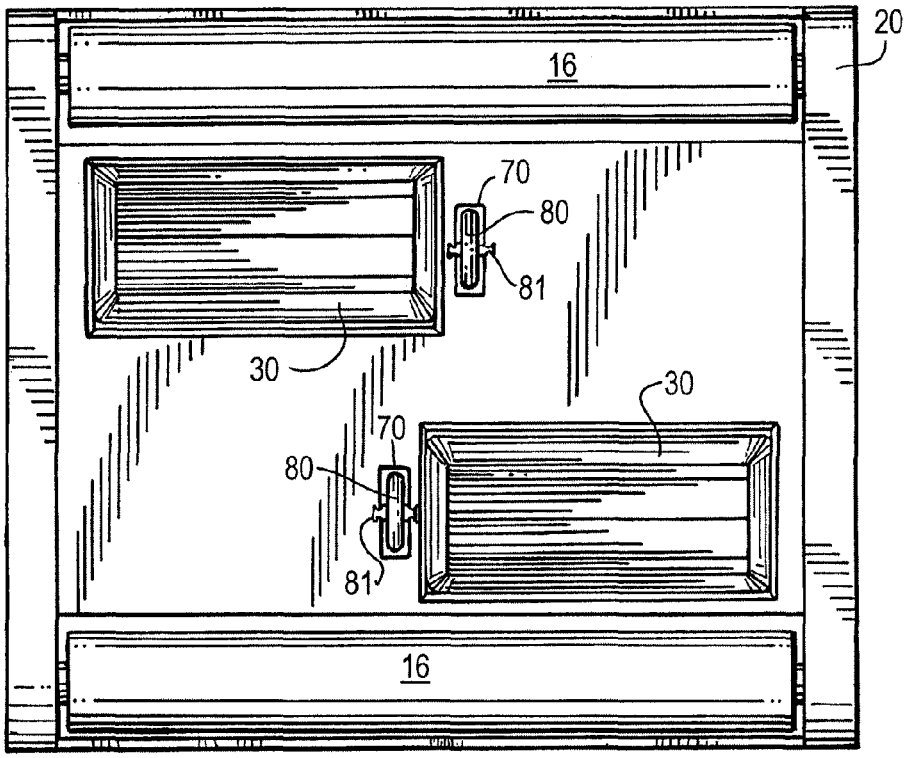
FIG. 8 is a bottom view of a swimming pool cleaner and baseplate with inlet extension members and wheel recesses of the present invention.

In order to remedy this problem where the pool cleaner is used in pools having obstacles projecting from the surface being cleaned, the baseplate is provided with one or more recesses for receiving axle-mounted wheels. Referring now to FIG. 8, recesses 70 are positioned adjacent the inlet extension members 30 and a wheel 80 mounted on an axle 81 is secured for rotation in each recess.

Figure 9:
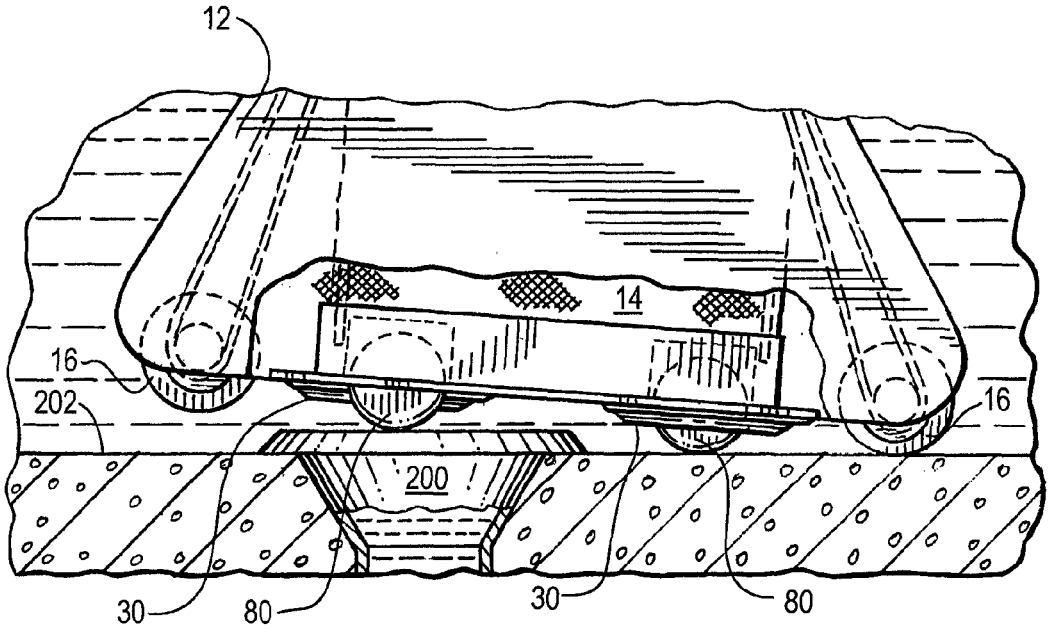
FIG. 9 is a view similar to that of FIG. 7 showing the pool cleaner equipped with the recessed wheels of the present invention rolling over the obstacle.

As best shown in FIG. 9, the wheels 80 project at least to the depth of the extension member 30, and preferably slightly deeper below the baseplate. This enables the pool cleaner 10 to ride up and over the projecting obstacle 200, thereby avoiding the immobilization and/or the diversion of the unit from its programmed cleaning pattern.

The axle-mounted wheels are preferably removably mounted in the recess 70. This can be accomplished by various mechanical fastening techniques that will be apparent to one of ordinary skill in the art, including molding channels in the baseplate that communicate with the recess and into which one or both of the opposing ends of the axle can be inserted in a releasable snap-fit relation; or by a mechanical fastener, e.g., a screw and optionally a bracket that retains the free end of the axle in position. This arrangement allows the user to determine whether a wheel is necessary and, if so, the option of selecting a wheel, or set of wheels, of a diameter that is appropriate for the height of projecting obstacles present in the pool. In this manner, the user can customize the pool cleaner based upon the conditions present in the pool.

In a particularly preferred embodiment, the recesses 70 are large enough to accommodate wheels of various diameters and the wheels are either sold to the user as a kit or by a supplier who maintains an inventory from which the user can select the appropriate sized wheels and accompanying inlet extension members 30.

As shown in the embodiment of FIG. 8, wheels 80 can be on opposite sides of the longitudinal centerline of the pool cleaner. These offset wheels permit the pool cleaner to ride over obstacles and prevent the apparatus from being immobilized on a pool drain cover or other protrusions from a surface over which the apparatus is traveling.

Again, with reference to FIG. 9, the wheels 80 roll over the projecting surface obstacle, e.g., pool drain cover 200 by preventing the inlet extension member 30 from contacting the obstacle. Referring to FIG. 9, it will also be understood that the wheels 80 can extend the same distance or less than the distance from the baseplate 20 as rollers 16, or other drive means that support the pool cleaner for movement.

FIG. 10 illustrates an alternate embodiment of the invention shown in FIG. 8, where a set of two wheels 82 are positioned in each of two sets of separate wheel recesses 70 positioned on opposite sides of the baseplate center line and adjacent the respective inlet extension members 30.

As shown in FIG. 11, the baseplate can also be configured so that a large recess 72 replaces each of the pair of recesses 70 shown in FIG. 10 so that a single roller 84, or two or more wheels (not shown) are mounted for rotation in each of the large recesses.

As also shown in phantom in FIG. 11, a single large recess 74 is centrally positioned between the two inlet extension members 30 to accommodate a single larger roller 86, or a plurality of wheels (not shown) mounted on a single releasable axle.

As previously explained, in order to optimize the position of the inlet opening and to maximize the amount of suction force to remove debris from the surface being cleaned, the present invention provides interchangeable inlet extension members which can be used to lower the suction point relative to the surface being cleaned. The interchangeable extension members can also be used to decrease the effective area of the suction openings to thereby increase the velocity of the water drawn into the inlet opening. When used in combination with the recessed wheels, the inlet extension members provide improved cleaning efficiency, even in pools having surface obstacles that could otherwise interfere with the patterned movement of the cleaner.

In another aspect, the present invention includes a vertically adjustable intake port which is provided along the bottom surface of a pool cleaner. More specifically, one or more intake ports provided on the base plate of the pool cleaner can be extended downward or retracted upward with respect to the bottom surface of the pool or tank. The extending or retracting of the height of the one or more intake ports is controlled by a height adjustment mechanism which, in one embodiment, can be manually set based on anticipated obstacles the cleaner may encounter while moving along its cleaning pattern. Alternatively, in other embodiments, the height adjustment mechanism responds to one or more sensors that are installed on the pool cleaner for sensing an obstacle and sending control signals to a controller, which automatically extends downward or retracts upward the adjustable intake port with respect to the bottom surface of the pool or tank. Such obstacles can include raised coverings of pool drains, raised water jets, pool toys, and other well-known impediments or obstacles that may be encountered by the pool cleaner during its cleaning operation.

The retractable intake ports and their height adjustment mechanisms enable the cleaner to traverse, over the obstacles without getting immobilized or otherwise "stuck" on the obstacle. Specifically, the adjustment mechanism allows the operator to set the retractable intake ports to any suitable height in the vertical direction with respect to the base plate and pool surface therebelow. Advantageously, each inlet port can be retracted or extended at any vertical position, i.e., from being flush with the base plate, being fully extended, or set at any height therebetween.

Figure 12:
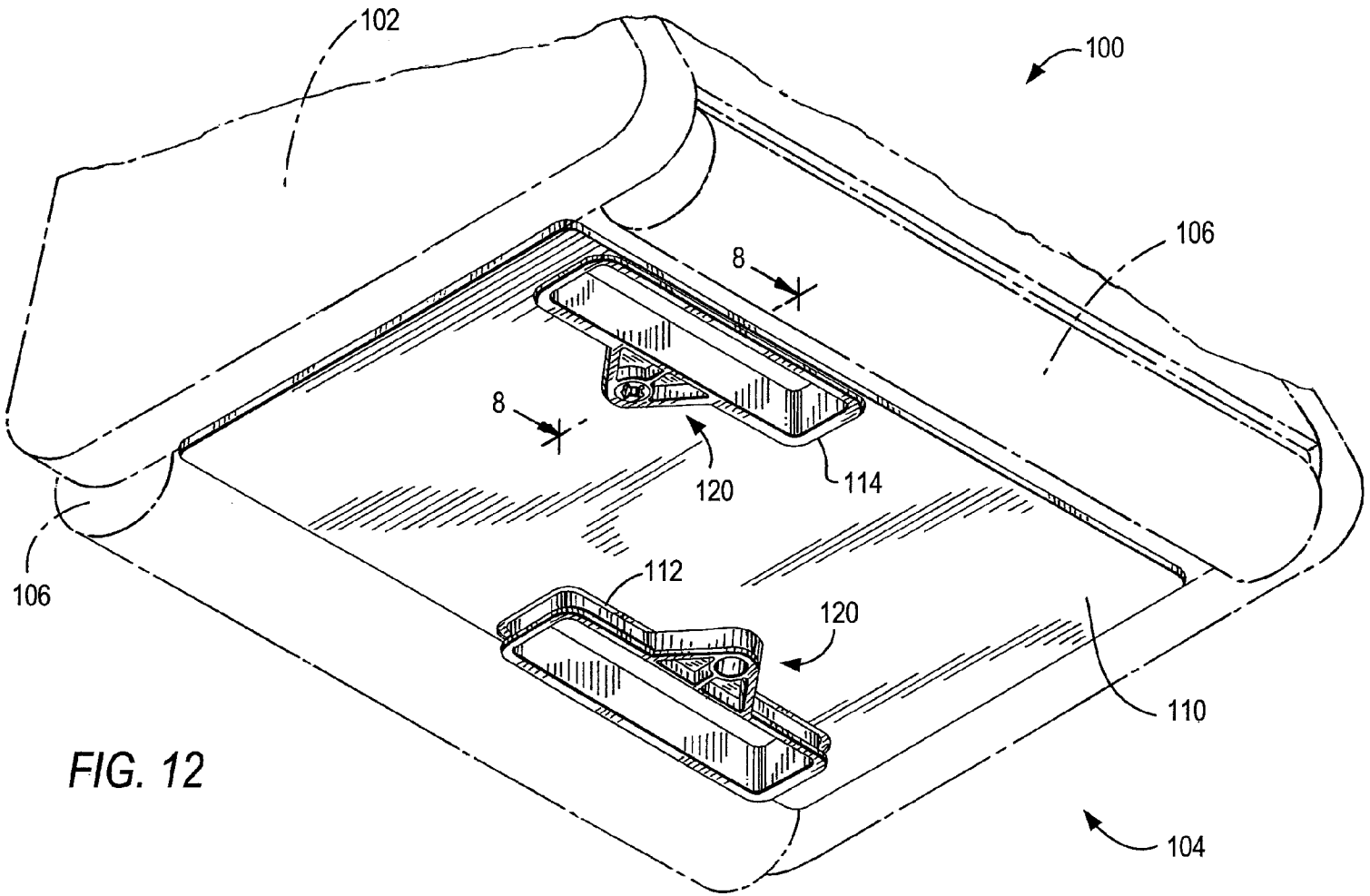
FIG. 12 is a bottom perspective view of a base plate in position on a pool cleaner, the later being shown in phantom, and illustrating a first embodiment of a height adjusting mechanism for changing the height of the inlet extension member with respect to the base plate of the pool cleaner.

Referring to FIG. 12, a representative self-propelled robotic pool cleaner 100 has an exterior housing 102, an internal filter assembly (not shown), transverse power driven rollers 106 and a base plate 110 is schematically depicted. The base plate 110 is attached to the bottom portion 104 of the housing 102 and, as illustrated, has two inlet openings 112 that can be closed by a pair of biased doors (not shown) that close when the water flow to the filter is stopped.

Each inlet opening 112 in the base plate 110 has been fitted with an inlet extension member, referred to generally as 114, which slidably extends downward from and retracts upward into the respective inlet opening 112. As shown in FIG. 12, each inlet extension member 114 can be controlled manually by a height adjustment mechanism 120 of the present invention.

Preferably, the lower surface of the inlet extension member 114 includes an outwardly extending flange 116 (FIG. 13) that overlaps the periphery of the corresponding inlet opening 112. The flange 116 prevents the inlet extension member 114 from retracting completely inside the inlet opening 112. Alternatively, the inlet extension member 114 does not include the outwardly extending flange 116, and the extension member 114 can be fully retracted within the housing 102 of the cleaner 100 and flush with the base plate 110.

Figure 13:
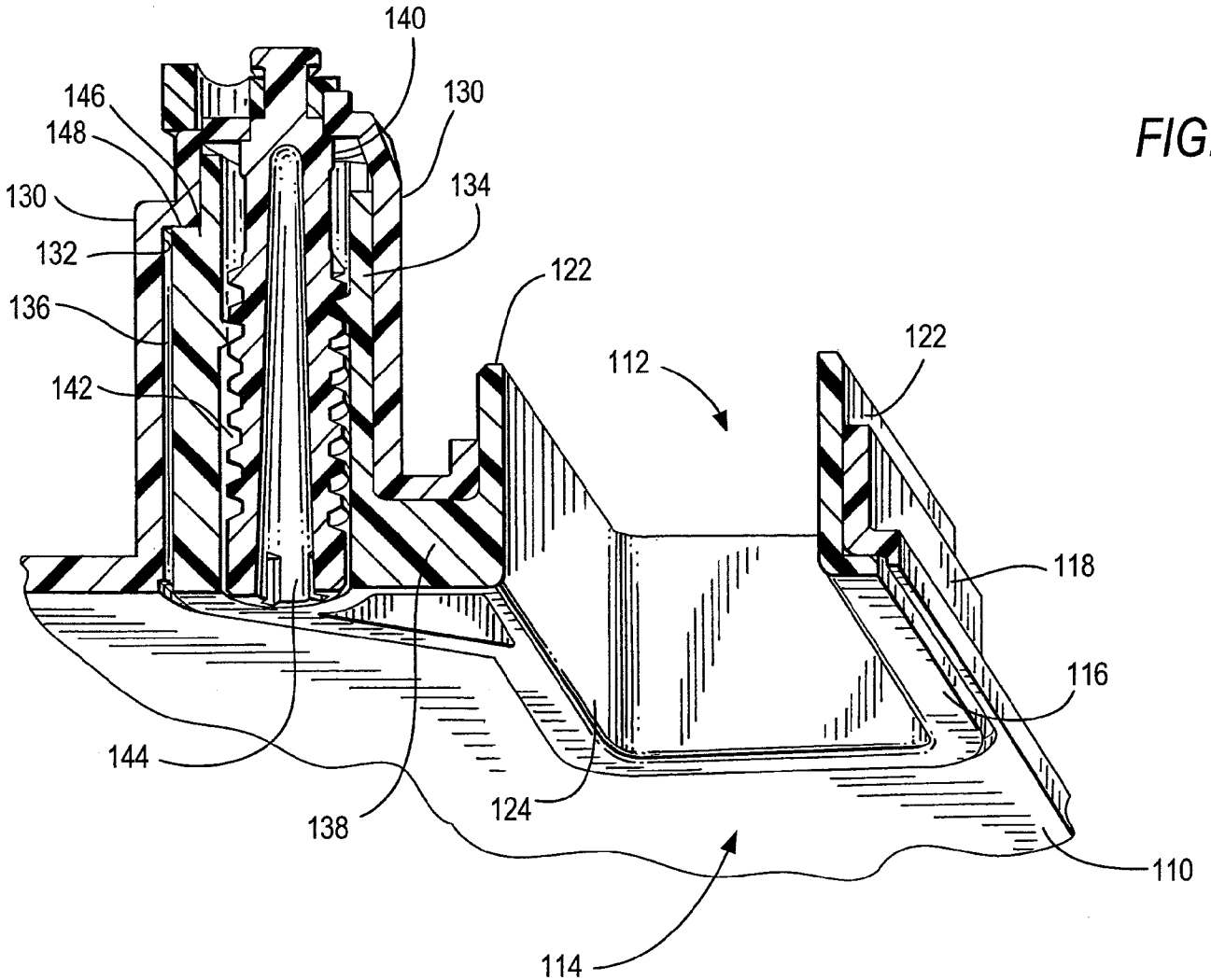
FIG. 13 is an enlarged bottom perspective view in partial cross-section of a segment of the base plate showing a mounting detail of a portion of the first embodiment of the height adjusting mechanism taken along line 2-2 of FIG. 1 and which illustrates the inlet extension member at a fully retracted position with respect to the base plate.
Figure 14:
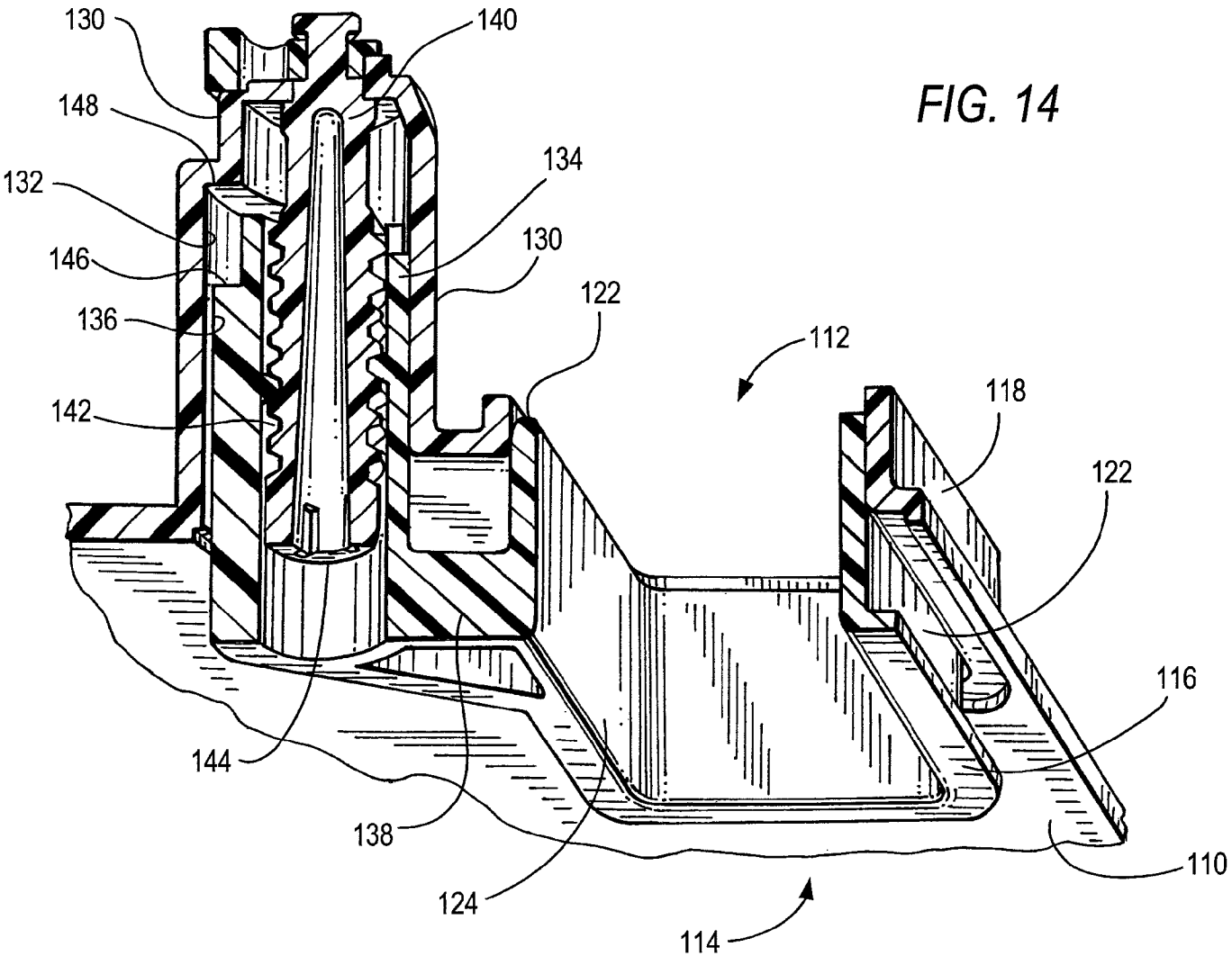
FIG. 14 is an enlarged bottom perspective view in partial cross-section of a segment of the base plate showing a mounting detail of a portion of the first embodiment of the height adjusting mechanism of FIG. 1 with the inlet extension member at an extended position with respect to the base plate.

Referring to FIGS. 13 and 14, the base plate 110 is substantially planar and can include a sidewall 118 that circumscribes at least a portion of the inlet opening 112 and serves as a support and a guide for the inlet extension member 114. In particular, the inlet extension member 114 includes at least one sidewall 122 that extends upwards and has a height greater than the sidewall 118 of the base plate 110. The sidewall 122 and lower portion 124 of the extension member 114 slide upward and downward with respect to the sidewall 118 and bottom surface of the base plate 110 in response to the operator manually adjusting the height adjustment mechanism 120 of the present invention.

The extension member 114 is illustratively rectangular in shape and conforms to the configuration of the inlet opening 112, although such shape is not considered limiting. The extension member 114 can be fabricated from a rigid or semi-rigid material which is water resistant, such as aluminum, polyvinyl chloride, among other well-known water, corrosion and chemical resistant materials.

As shown in FIGS. 13 and 14, in one embodiment the height adjustment mechanism 120 comprises an external sleeve 130 which is stationary and functions as a housing for the height adjustment mechanism 120. The external sleeve 130 is cylindrical in shape and has an inner diameter 132 that accommodates a cylindrical internal sleeve 134. Accordingly, the inner diameter 132 of the external sleeve 130 is greater than the outer diameter 136 of the internal sleeve 134. The internal sleeve 134 is slidably inserted into the stationary external sleeve 130 and can be manually set at a predetermined fixed position by an adjustable set screw or threaded bolt 140. The internal sleeve 134 includes a lower connecting flange 138 that is affixed to the sidewall 122 of the extension member 114.

In particular, the internal sleeve 134 includes a threaded channel 142 that is configured to interface with the threaded bolt 140. The threaded bolt 140 preferably includes a well-known slotted head or Philips head 144 that can be easily turned clockwise and counter-clockwise to extend and retract the extension member 114.

In one embodiment, the external sleeve 130 includes an internal shoulder 148 and the internal sleeve 134 includes an external shoulder 146. The external shoulder 146 of the internal sleeve 134 is configured to abut against the internal shoulder 148 of the external sleeve 130 when the extension member 114 is in its fully retracted position with respect to the inlet opening 112. The internal shoulder 148 and external shoulder 146 interface arrangement prevents the operator from overtightening the threaded bolt 140.

Referring to FIG. 13, the extension member 114 is illustratively shown in its fully retracted state such that the upper surface of the flange 116 is flush against the bottom surface of the base plate 110. As shown in the retracted state, the external shoulder 146 of the internal sleeve 134 abuts against the internal shoulder 148 of the external sleeve 130. Referring to FIG. 14, in comparison the extension member 114 is shown extended vertically down from the bottom surface of the base plate 110 and the internal sleeve 134 is also displaced downward from the external sleeve 130. Accordingly, the external shoulder 146 of the, internal sleeve 134 no longer abuts against the internal shoulder 148 of the external sleeve 130. Also shown in FIG. 14 is the sidewall 122 of the extension member 114 is now lower with respect to the adjacent sidewall 118 of the base plate 110.

Prior art pool cleaners that include an inlet extension member which has a lower surface that projects sufficiently below base plate 110 can come into frictional contact with obstacles projecting above the surface of the pool or tank that is being cleaned. For example, a water inlet or drain cover that projects above pool surface can immobilize the pool cleaner 100 as a result of one or both of rollers 106 making insufficient frictional contact to maintain the movement of the unit.

Referring now to FIG. 15, the pool cleaner 100 is shown moving over an obstacle 164 formed along the bottom surface 162 of the pool 160. The obstacle 164 illustratively shown in the drawings is a water inlet that extends upward from the bottom surface 162 of the pool 160. As the height of the water inlet obstacle 164 is known or can be readily obtained, and the operator can adjust the height of the extension members 114 such that they will contact or otherwise become impeded by water inlet obstacle 164 as the cleaner 100 moves along the bottom surface 162 while running along its cleaning pattern. In particular, the operator turns the threaded bolt 140 in a predetermined rotational direction, i.e., clockwise or counter-clockwise, to raise the extension member 114 with respect to the pool surface 162 so that it is retracted to a height that will clear the known obstacle (e.g., water inlet) 164.

Referring to FIG. 16, alternatively where the water inlet is recessed or flush with the pool surface 162, the extension members 114 can be extended downward to maximize suction and cleaning efficiency. A person of ordinary skill in the art will appreciate that the distance that the extension members 114 can be extended is unlimited as between the fully recessed and fully extended states. In this instance, the operator turns the threaded bolt 140 in the opposite direction to lower the extension member 114 with respect to the pool surface 162 so that it is extended to a height that will maximize suction of the cleaner and increase cleaning efficiency along the pool surface 162.

Accordingly, the lesser depth of inlet extension member 114 raises the suction point of the cleaning apparatus closer to the base plate 110. The use of an adjustable extension member having lesser depth can be beneficial in situations where, for example, obstacles project higher from the surface to be cleaned and would otherwise immobilize or significantly divert the pool cleaner from its intended programmed movement pattern by contacting the rim of the inlet extension member.

Referring now to FIG. 17, the pool cleaner 100 includes a height adjustment mechanism 120 that automatically controls the height of the inlet extension members 114, a compared to the height adjustment mechanism of FIGS. 12-16, which enabled manual control of the height of the inlet extension members relative to the bottom surface 162 of the pool 160. The cleaner 100 further includes one or more sensors 150 mounted on the housing at a forward position to sense an obstacle 164 (e.g., water inlet) that is along the cleaning path of the cleaner as it moves along the pool surface 162. The sensors 150 can also be mounted along other strategic positions on the housing 102 to detect when the obstacle has been cleared or detect other obstacles the cleaner may encounter. The sensor(s) 150 can be a touch sensor, a capacitive proximity sensor, an ultrasonic sensor, a laser sensor, a pressure sensor or any other well-known sensor capable of detecting irregularities along the underlying surface 162 of the pool 160.

The sensors 150 are communicably coupled to a controller 152 illustratively via one or more electrical conductors 151 or other well-known conduits, such as fiber-optic filaments and the like. The controller 152 can be any well-known microcontroller or processor with memory, which can store and execute program routines such as cleaning pattern routines, as well as receive input signals from the sensor 150 and in response, send control signals to the height adjustment mechanism 120 via one or more electrical conductors 153. As illustratively shown in FIG. 17, as the pool cleaner 100 moves along the surface 162 of the pool 160, the sensor 150 detects any obstacle (e.g., water inlet) 164 that are jutting along the regularly substantially smooth and unimpeded pool surface 162.

During operation, when an obstacle is encountered along the cleaning path of the cleaner 100 by the sensor 150, the sensor 150 sends an output signal to the controller 152 via conductor 151. In response, the controller 152 sends an activation or command signal to the height adjustment mechanism 120 to retract the inlet extension member(s) 114 from their extended position. In one embodiment, the inlet extension members can be in a fully extended position relative to the base plate 110 of the cleaner 100 as a default position. In this manner the height adjustment mechanism 120 raises the inlet extension members 114 when an obstacle 164 is detected and then lowers the inlet extension members to the extended default position once the obstacle 164 is cleared.

The controller 152 of FIG. 17 can include a processor or a micro-processor, as well as memory for storing various control programs. The processor cooperates with conventional support circuitry, such as power supplies, clock circuits, cache memory and the like, as well as circuits that assist in executing the software routines stored in the memory. As such, it is contemplated that some of the process steps discussed herein as software processes can be implemented within hardware, for example, as circuitry that cooperates with the processor to perform various steps. The controller 152 also contains input/output (I/O) circuitry that forms an interface between the various functional elements communicating with the controller 150. For example, as shown in the embodiment of FIG. 17, the controller 152 communicates with the sensor device 150 via a signal path 151 and the height adjustment mechanism 120 via signal path 153. The controller 152 can also communicate with additional functional elements (not shown), such as those described herein as relating to controlling the steering pattern of the cleaner, providing power to the rollers, controlling water jet propulsion, and other functions and operations of the pool cleaner 100.

Although the controller 152 of FIG. 17 is depicted as a general-purpose microcontroller that is programmed to perform various defined and/or control functions for specific purposes in accordance with the present invention, the invention can be implemented in hardware such as, for example, an application specific integrated circuit (ASIC). As such, it is intended that the processes described herein be broadly interpreted as being equivalently performed by software, hardware, or a combination thereof.

Referring now to FIG. 18, a second embodiment of the height adjustment mechanism 120 is illustratively shown. The height adjustment mechanism 120 is similar the height adjustment mechanism of FIGS. 13 and 14, except that a reversible motor 154 is provided to raise and lower the threaded bolt 140 in the threaded channel 142 associated with each inlet extension member 114. The reversible electrical motor 154 can automatically raise and lower an inlet extension member 114, as opposed to having to manually turn the threaded bolt 140 as described above with respect to FIGS. 12-16.

As illustratively shown in FIG. 18, the reversible motor 154 is mounted to the outer sleeve 130 illustratively by a bracket 157 and includes a drive gear 156 which interfaces (i.e., meshes) with a secondary gear 158 that is positioned over the upper portion of the outer sleeve 130 and is fixedly attached along its central axis to the top end of the threaded bolt 140. A bore 128 is provided through the upper portion of the outer sleeve 130 to facilitate attachment of the secondary gear 158 to the top end of the threaded bolt 140. When the controller 152 sends an electrical signal through conductor(s) 153, the electrical motor 154 will rotate either clockwise or counter-clockwise, depending on the polarity of the input signal from the controller 152. The motor 154 rotates the drive gear 156 in the same direction, which in turn rotates the secondary gear 158 in an opposite direction. As the secondary gear 158 and threaded bolt 140 rotate, the threads of the threaded bolt 140 force the inner sleeve 132 to turn and move either upward or downward with respect to the outer sleeve 130. When the inner sleeve 132 contemporaneously rotates and moves in either the upward or downward direction, the inlet extension member 114, which is fixedly attached to the inner sleeve 132 via the lower connecting flange 138, simultaneously retracts upward or extends downward with respect to the bottom surface of the base plate 110. Accordingly, the inner sleeve 132 and the threaded bolt 140 collectively interact as a linear actuator. Moreover, a person of ordinary skill in the art will appreciate that in an alternative embodiment, a servo motor or other well-known actuator can be implemented to rotate the secondary gear 158.

The controller 152 stores in its memory the current position of the inlet extension member 114 relative to the base plate 110. Upon receiving a signal from the sensor 150 that signifies a change along the surface of the pool, the controller 152 will determine and send an appropriate signal to the motor 154 to rotate the threaded bolt 140 in a direction that will either retract or extend the inlet extension member 114. If, for example, the sensor 150 detects an oncoming obstruction and sends a signal to the controller 152, the controller will determine the current position of the inlet extension member 114 and if it is extended, a command signal is sent to the electric motor 154 to turn in a predetermined direction (e.g., clockwise) to rotate the threaded bolt 140 in a counter-clockwise direction and subsequently move the inner sleeve 130 and affixed inlet extension member 114 in an upward and retracted position. Once the obstacle has been cleared, the sensor 150 will send a second signal to the controller 152 and the controller will send a signal via conductor 153 to the motor 154 to turn in the opposite direction (e.g., counter-clockwise) to thereby move the inner sleeve 130 and affixed inlet extension member 114 in a downward and extended position.

Figure 19:
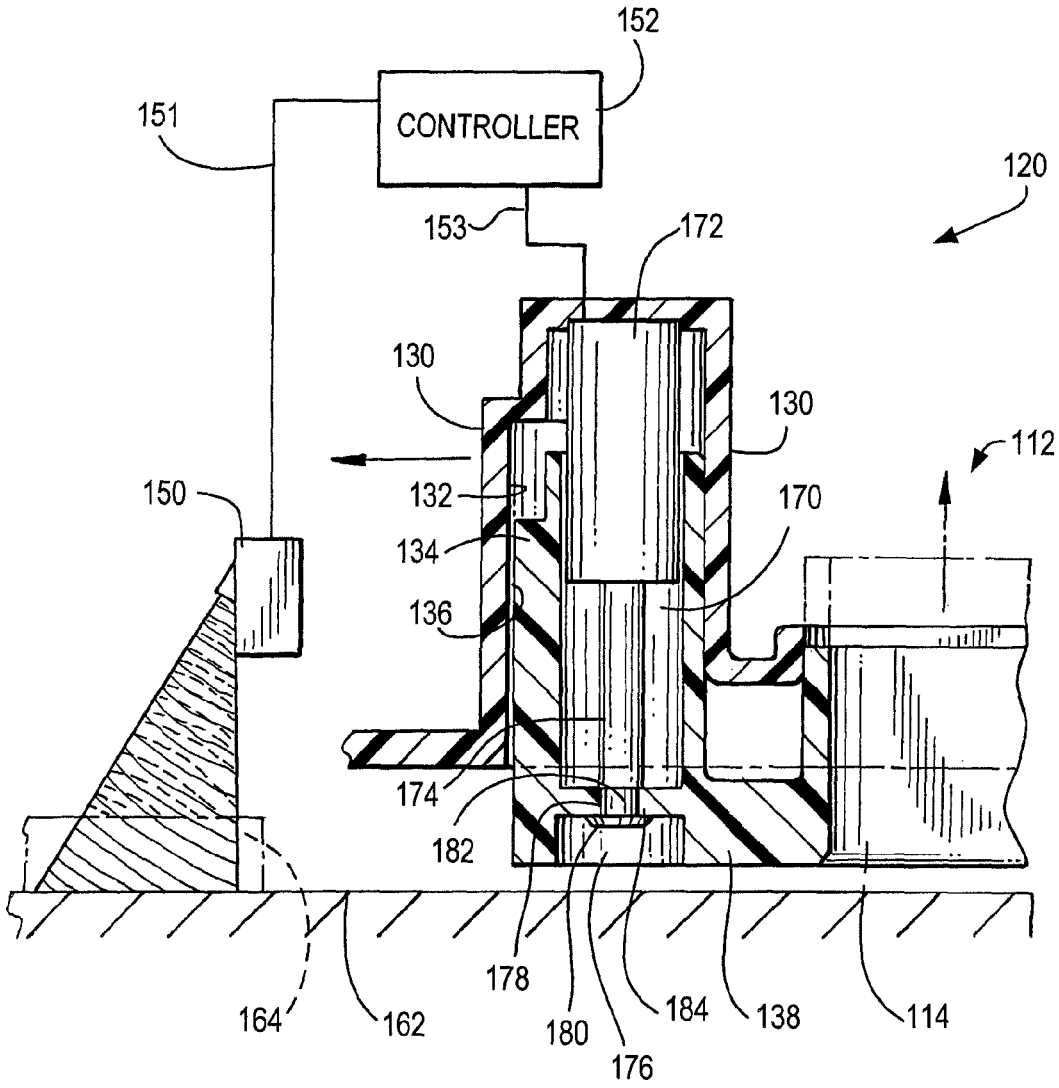
FIG. 19 is an enlarged side elevation view of a portion of the pool cleaner of FIG. 6 illustrating a third embodiment of the height adjustment mechanism of the present invention.

Referring now to FIG. 19, a third embodiment of the height adjustment mechanism 120 is illustratively shown. The third embodiment of the height adjustment mechanism 120 is similar the second embodiment of the height adjustment mechanism of FIG. 18, except that an actuator 172 is provided to raise and lower the inlet extension member 114. The actuator 172 is preferably a multi-position linear actuator that can automatically raise and lower an inlet extension member 114, as opposed to having to manually turn the threaded bolt 140 as described above with respect to FIGS. 12-16.

The implementation of the outer sleeve 130 and inner sleeve 134 configuration for the inlet extension member as described above with respect to FIGS. 12-18 is also suitable for use in this third embodiment. However, the actuator 172 and plunger or rod 174 is provided instead of the step screw 140 of the previous embodiments. In particular, the top portion of the actuator 172 is mounted longitudinally to the interior top portion of the outer sleeve 130. The actuator 172 and rod 174 extend downward within the interior portions of the fixed outer sleeve 130 and the slidable inner sleeve 134, and preferably along their central longitudinal axes. A distal end 182 of the rod 174 is fastened to the lower end 184 of the inner sleeve 134 by a fastener 180. For example, a bore 178 can be formed through the lower end 184 of the inner sleeve 134 and the fastener 180, such as a set screw or rivet extends therethrough. The fastener 180 fixedly interfaces with and secures the lower end 184 of the inner sleeve 134 with the distal end 182 of the actuator rod 174.

During operation, when the controller 152 sends an electrical signal through conductor(s) 153, the actuator 172 will cause the rod 174 to slidably move linearly in either an upward or downward direction, depending on the polarity of the input signal from the controller 152. As the actuator rod 174 moves either upward or downward, the fixedly attached inner sleeve 132 also moves in unison, i.e., in either the upward or downward directions with respect to the outer sleeve 130. When the inner sleeve 132 moves either upward or downward, the inlet extension member 114, which is fixedly attached to the inner sleeve 132 via the lower connecting flange 138, simultaneously retracts upward or extends downward with respect to the bottom surface of the base plate 110.

As described above with respect to the second embodiment of FIG. 18, the controller 152 stores in its memory the current position of the inlet extension member 114 relative to the base plate 110. A person of ordinary skill in the art will appreciate that the positioning of the inlet extension member 114 can be stored in one or more tables or other data structures that are readily accessible to the controller 152 during execution of the cleaning programs and/or during detection of an obstacle 164 by the sensor 150. Upon receiving a signal from the sensor 150 that signifies a change along the surface of the pool, the controller 152 will determine and send an appropriate signal to the actuator 172 to move the rod 174 in an upward or downward direction to respectively retract or extend the inlet extension member 114. If, for example, the sensor 150 detects an oncoming obstruction and sends a signal to the controller 152, the controller will determine the current position of the inlet extension member 114 and if it is extended, a command signal is sent to the actuator 172 to move the rod 174 upwardly direction and contemporaneously move the inner sleeve 130 and affixed inlet extension member 114 in an upward and retracted position. Once the obstacle has been cleared, the sensor 150 will send a second signal to the controller 152 and the controller will send a signal via conductor 153 to the actuator 172 to move in the opposite direction (e.g., downward) to thereby move the inner sleeve 130 and affixed inlet extension member 114 in a downward and extended position.

A person of ordinary skill in the art will appreciate that the distance that the inlet extension member 114 moves in either the upward or downward direction can be controlled by the controller 152. That is, the controller 152 can limit the rotation of the electric motor 154 (FIG. 18) or the distance the actuator rod 174 moves upward or downward (FIG. 19) to thereby control the height of the inlet extension member 114 with respect to the base plate 110. In this manner, the inlet extension member 114 can be set at any position between the fully extended or fully retracted positions with respect to the base plate 110. In particular, the controller 152 can store in its memory one or more data structures that include a series of samples of the pool surface 160 and any oncoming obstacles 164 (e.g., water inlets and the like) which are taken by the sensors 150 over a predetermined time as the cleaner 100 traverses the pool 160. The samples stored in the memory of the controller 152 can include changes in the height of the pool surface relative to previous measurements. The processor or microcontroller of the controller 152 can execute routines or programs stored in the memory which can determine the height of an oncoming obstacle, as well as determine an optimal height to retract the inlet extension member 114 to avoid collision therewith, and still provide maximum suction and cleaning efficiency.

As previously explained, in order to optimize the position of the inlet opening and to maximize the amount of suction force to remove debris from the surface being cleaned, the present invention provides height adjustable inlet extension members which can be used to lower the suction point relative to the surface being cleaned. The adjustable extension members can also be used to decrease the effective area of the suction openings to thereby increase the velocity of the water drawn into the inlet opening. Accordingly, the height adjustable inlet extension members provide improved cleaning efficiency, even in pools having surface obstacles that could otherwise interfere with the patterned movement of the cleaner.

While the foregoing is directed to various embodiments of the present invention, additional embodiments will be apparent to those of ordinary skill in the art without departing from the basic principles and the scope of the invention is to be determined by the claims that follow.

We claim:

1. A base plate for a self-propelled robotic cleaning apparatus for cleaning a submerged surface of a pool or tank, the base plate having a bottom surface and a water inlet formed therethrough and further comprising:

an inlet extension member mounted in the water inlet, the inlet extension member being slidably retractable and extendable in a direction that is normal relative to the bottom surface of the base plate; and a height adjustment mechanism coupled to the inlet extension member and configured to move the inlet extension member upwardly and downwardly in the direction normal to the bottom surface of the base plate, the inlet extension member having a fully retracted height position and fully extended height position in the direction normal to the bottom surface of the base plate, and wherein the height adjustment mechanism is further configured to control movement and fixedly retain the inlet extension member in the fully extended height position, the fully retracted height position, or at an intermediate position between the fully extended and fully retracted height positions during a cleaning operation of the pool or tank.

2. The base plate of claim 1, wherein the inlet extension member includes at least one sidewall extending substantially normal to the bottom surface of the base plate.

3. The base plate of claim 2, wherein the inlet extension member includes a flange extending outwardly from a lower portion of the at least one sidewall of the inlet extension member, and wherein said outwardly extending flange overlaps a portion of the bottom surface of the base plate.

4. The base plate of claim 2, further comprising at least one sidewall extending upward into the interior of the housing in a direction substantially normal to the bottom surface of the base plate and adjacent to a respective at least one sidewall of the inlet extension member.

5. The base plate of claim 1, wherein the height adjustment mechanism is coupled to the inlet extension member via a connecting flange.

6. The base plate of claim 5 wherein the height adjustment mechanism comprises a threaded member for adjusting the distance the inlet extension member extends relative to the bottom surface of the base plate, the threaded member being rotatable in either a clockwise or counter-clockwise direction to retract and extend the inlet extension member.

7. The base plate of claim 6, wherein the height adjustment mechanism further comprises an external sleeve fixedly mounted to an upper surface of the base plate and having a cylindrical interior channel, and a cylindrical internal sleeve slidably positioned coaxially within the cylindrical interior channel of the external sleeve, said internal sleeve having an internal channel that is threaded and configured to interface with the threaded bolt.

8. The base plate of claim 7, wherein the internal sleeve is coupled to a sidewall of the inlet extension member by the connecting flange.

9. The base plate of claim 7, wherein one of clockwise rotation or counter-clockwise rotation of the threaded bolt causes the internal sleeve and the inlet extension member to move contemporaneously in a normal direction relative to the bottom surface of the base plate.

10. The base plate of claim 5, wherein the height adjustment mechanism is manually operated.

11. The base plate of claim 5, wherein the height adjustment mechanism is coupled to an electric motor, said electric motor being operable to control the distance the inlet extension member extends relative to the bottom surface of the base plate.

12. The base plate of claim 11, wherein the height adjustment mechanism is communicably coupled to a sensor mounted to the cleaning apparatus, said sensor being operable to send control signals to the electric motor to retract the inlet extension member in response to sensing an obstacle on the submerged surface while the cleaning apparatus moves along the submerged surface of a pool or tank.

13. The base plate of claim 12, wherein the sensor is operable to send control signals to the electric motor to extend the inlet extension member in response to sensing that the obstacle has been cleared while the cleaning apparatus moves along the submerged surface of a pool or tank.

14. The base plate of claim 11, wherein the height adjustment mechanism controls the distance the inlet extension member extends relative to the bottom surface of the base plate in response to receiving one or more control signals from a controller which processes input signals from the sensor.

15. The base plate of claim 14, wherein the distance the inlet extension member is extendible relative to the bottom surface of the base plate is in the range of being fully retracted and fully extended.

16. The base plate of claim 11, wherein the electric motor is a reversible motor having a drive gear and the height adjustment mechanism comprises:

a threaded member having a driven gear and for adjusting the distance the inlet extension member extends relative to the bottom surface of the base plate;

an external sleeve fixedly mounted to an upper surface of the base plate and having a cylindrical interior channel, a cylindrical internal sleeve being slidably positioned coaxially within the cylindrical interior channel of the external sleeve, said internal sleeve having an internal channel that is threaded and configured to interface with the threaded member, and wherein the internal sleeve is coupled to a sidewall of the inlet extension member by the connecting flange; and wherein the a drive gear interfaces with the driven gear to rotate the threaded bolt in either a clockwise or counter-clockwise direction to retract and extend the inlet extension member to any one of a fully retracted position, a fully extended position and to any position therebetween.

17. The base plate of claim 11, wherein the electric motor is an actuator and the height adjustment mechanism comprises:

an actuator rod extending longitudinally from the actuator for adjusting the distance the inlet extension member extends relative to the bottom surface of the base plate;

an external sleeve fixedly mounted to an upper surface of the base plate and having a cylindrical interior channel, a cylindrical internal sleeve being slidably positioned coaxially within the cylindrical interior channel of the external sleeve, said internal sleeve having an internal channel for receiving the actuator rod, and wherein the internal sleeve is coupled to a sidewall of the inlet extension member by the connecting flange; and wherein the actuator rod is fastened to a portion of the internal sleeve to move the internal sleeve in either an upwardly or downwardly direction to retract and extend the inlet extension member to any one of a fully retracted position, a fully extended position and to any position therebetween.

18. A method for extending and retracting an inlet extension member associated with a water inlet formed in a base plate of a self-propelled robotic cleaning apparatus for cleaning a submerged surface of a pool or tank, the cleaning apparatus including a housing having a front portion, an opposing rear portion and adjoining side portions defining an interior and exterior periphery of the cleaning apparatus; rotationally-mounted supports coupled proximate the front and rear portions of the housing, and a base plate having a bottom surface and a water inlet formed therethrough; the inlet extension member configured to slidably mount in the water inlet to slidably retract and extend in a direction that is normal relative to the bottom surface of the base plate; and a height adjustment mechanism coupled to the inlet extension member and configured to move the inlet extension member upwardly and downwardly in the direction normal to the bottom surface of the base plate; and a sensor mounted to the housing and operably coupled to the height adjustment mechanism, said sensor operable to send control signals to an electronic controller having at least one input for receiving output signals from the sensor and an output for transmitting control signals to the height adjustment mechanism to control the distance the inlet extension member extends relative to the bottom surface of the base plate, the method comprising:

moving the cleaning apparatus along a cleaning path on the submerged surface of the pool;

sensing an obstacle which is protruding upward from the submerged surface of the pool along the cleaning path and ahead of the cleaning apparatus; and in response to sensing the obstacle, automatically retracting the inlet extension member into the base plate a predetermined distance prior to the cleaning apparatus contacting the obstacle along the cleaning path.

19. The method of claim 18, further comprising automatically extending the inlet extension member from the base plate a predetermined distance after the cleaning apparatus has cleared the obstacle along the cleaning path.

* * * * *